United States Patent [19]

Oger et al.

[11] 3,984,956

[45] Oct. 12, 1976

[54] CASING VOUSSOIR

[75] Inventors: Jacques François Oger, Pont-a-Mousson; Jean Claude Victor Hauer, Saulxures les Nancy, both of France

[73] Assignee: Pont-A-Mousson S.A., Nancy, France

[22] Filed: Dec. 17, 1974

[21] Appl. No.: 533,591

[30] Foreign Application Priority Data

Dec. 20, 1973 France ..... 73.45800

[52] U.S. Cl. ..... 52/249; 52/725; 61/41 R; 61/45 R; 61/85

[51] Int. Cl.[2] ..... E04G 11/04; E21D 5/11; E21D 11/08

[58] Field of Search ..... 52/249, 231, 245, 319, 52/724, 725, 414, 89, 415, 189, 437, 190, 438, 439, 579, 599, 598; 61/84, 85, 41, 45 R

[56] References Cited

UNITED STATES PATENTS

| | | | |
|---|---|---|---|
| 413,384 | 10/1889 | Beecher | 61/84 |
| 947,514 | 1/1910 | Stevens | 52/724 |
| 1,285,051 | 11/1918 | Cramer | 52/724 |
| 1,898,864 | 2/1933 | Young | 52/599 |
| 1,922,774 | 8/1933 | Maul et al. | 52/599 |
| 1,924,801 | 8/1933 | Olmsted | 52/438 X |
| 2,086,525 | 7/1937 | Akers | 52/599 |
| 3,088,246 | 5/1963 | Thiman | 52/231 X |
| 3,404,500 | 10/1968 | Akita et al. | 52/249 |
| 3,411,826 | 11/1968 | Wallers et al. | 61/85 X |
| 3,415,063 | 12/1968 | Akita et al. | 61/85 X |
| 3,751,929 | 8/1973 | Bernold | 52/249 X |
| 3,815,370 | 6/1974 | Lennox | 52/245 X |

FOREIGN PATENTS OR APPLICATIONS

| | | | |
|---|---|---|---|
| 1,353,464 | 1/1964 | France | 52/437 |
| 1,145,789 | 10/1957 | France | 52/245 |
| 1,366,593 | 6/1964 | France | 61/84 |
| 745,215 | 2/1956 | United Kingdom | 52/245 |

*Primary Examiner*—Price C. Faw, Jr.
*Assistant Examiner*—Leslie A. Braun
*Attorney, Agent, or Firm*—Sughrue, Rothwell, Mion, Zinn and Macpeak

[57] ABSTRACT

A composite casing voussoir of the type constituted by a mass of concrete or like material and a metal reinforcement. The latter comprises a web having the general shape of a portion of a cylinder and a peripheral radially-extending fixing frame which has a curvilinear rectangular shape. The mass of concrete occupies a cavity of the reinforcement which cavity is open at least partly in a radial direction. According to the invention, the reinforcement has means for hooking the mass of concrete constituted by a projecting flange located over said cavity.

7 Claims, 4 Drawing Figures

CASING VOUSSOIR

The present invention relates to a composite casing voussoir for in particular the internal covering of underground passages or tunnels.

The walls of passages or tunnels are easily covered with coverings constituted by voussoirs of steel, cast iron, plastics material or concrete which resist deterioration of the profile of the surrounding ground. On the other hand, each voussoir is subjected to high stress due to the decompression of the excavated ground. This decompression may or may not be uniform in which latter case there arise bending moments which are added to the effect of the compressive forces. These stresses may also come from hydraulic pressure in the region of the passage when there is an approach or rise of water.

An object of the invention is to provide a voussoir which operates under optimum conditions under compression while having minimum weight.

According to the invention there is provided a voussoir constituted by a mass of concrete or like material and a reinforcement comprising a web having the general shape of a portion of a cylinder and a peripheral radially extending fixing frame of curvilinear rectangular shape, the mass of concrete occupying a cavity of the reinforcement which is open at least partially in the radial direction, wherein the reinforcement has means for hooking the mass of concrete comprising a projecting flange disposed over and above said cavity.

Thus, the cooperation of the concrete and reinforcement affords optimum stifness for the casing, the stressing of the latter enabling it to balance the action of the exterior forces and the concrete and reinforcement being both put under stress. This concrete and this reinforcement participate jointly in the resistance offered by the casing to the pressure of the surrounding ground all the better as means are provided for hooking them together.

Further features and advantages of the invention will be described hereinafter with reference to the accompanying drawings given by way of example and in which.

Figure 1:
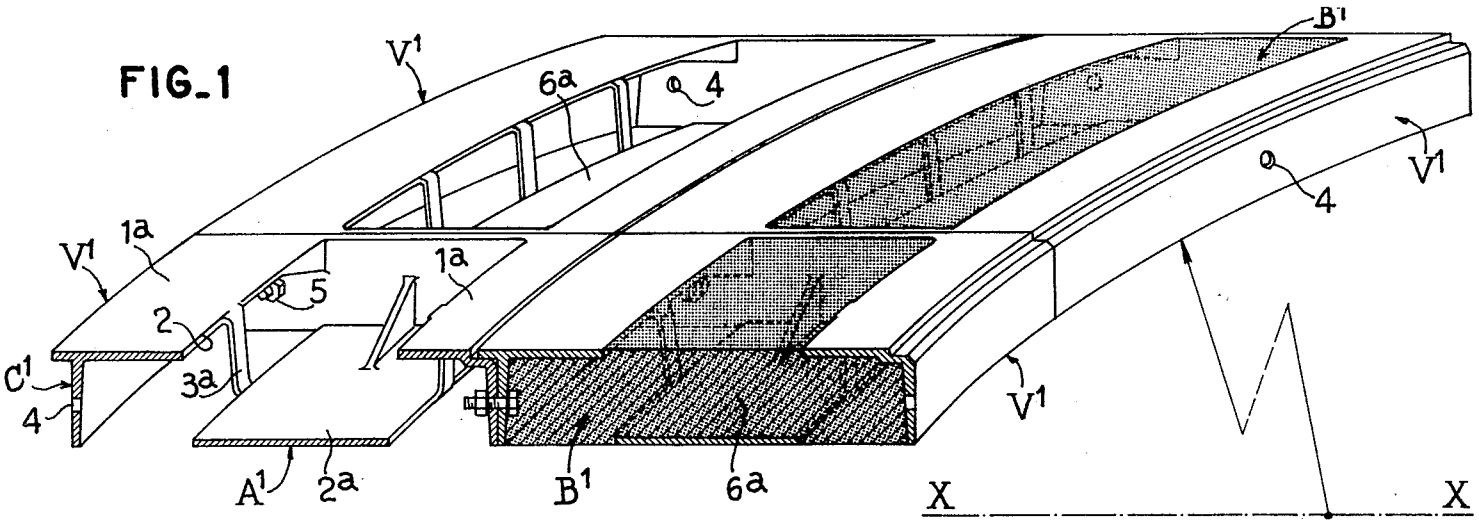
FIG. 1 is a perspective view of an assembly, partly in section, of several voussoirs according to a first embodiment of the invention.
Figure 3:
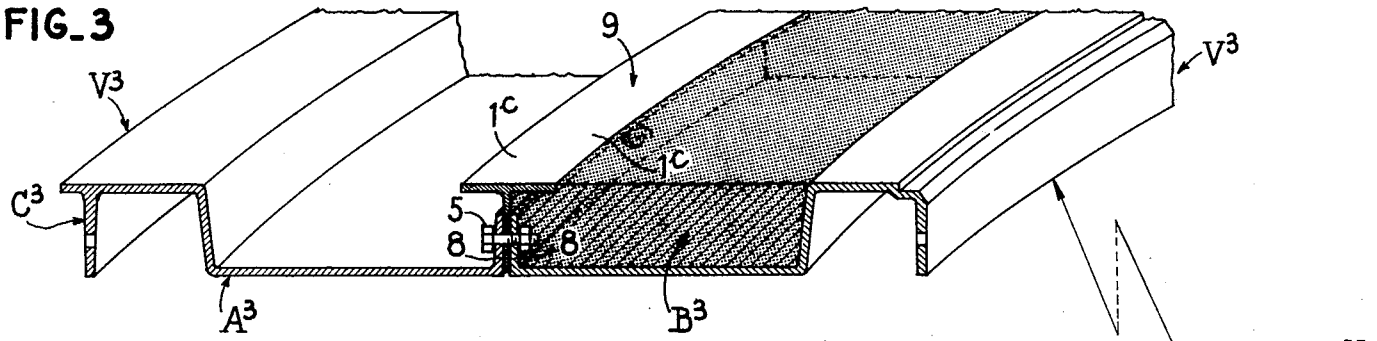
Figure 4:
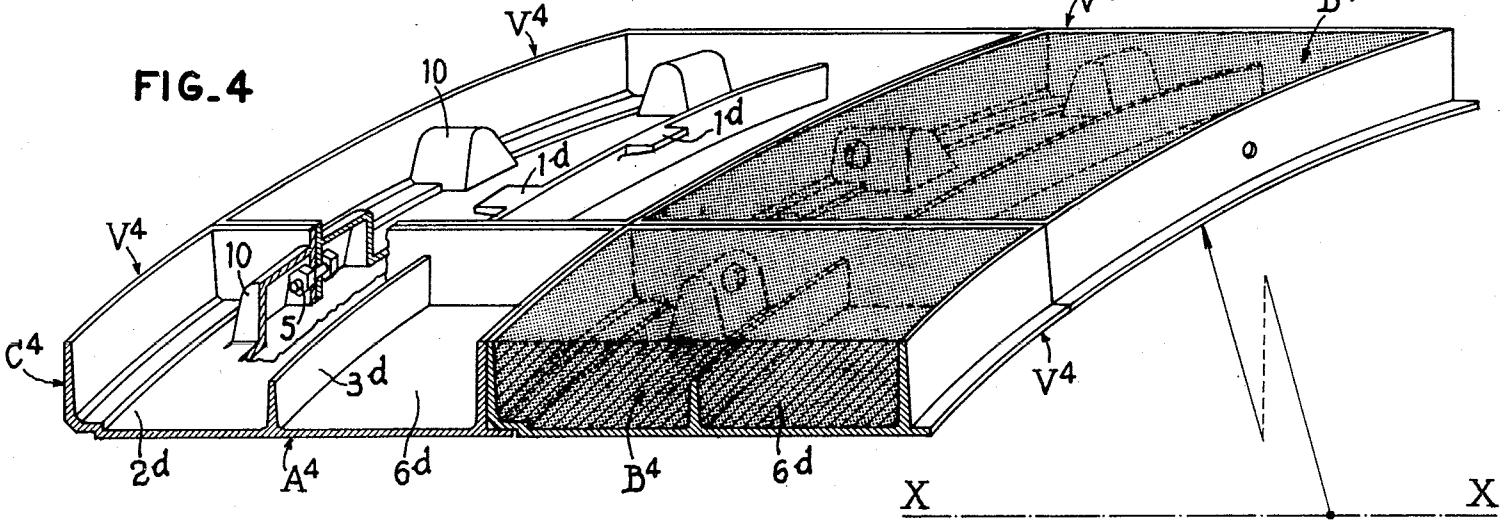
FIG. 4 is a view similar to FIG. 1 of an assembly of voussoirs according to a fourth embodiment of the invention.

The assemblies shown in FIGS. 1 and 4 each comprise four voussoirs which are absolutely identical to each other and assembled in accordance with a generally cylindrical shape having an axis x—x, these voussoirs being assembled in pairs in the axial direction and in pairs in the circumferential direction. One of the axial pairs of voussoirs is shown sectional in its middle in a meridian plane so as to show the structure of the voussoirs more clearly. It is moreover obvious that the assembly shown is only limited to four voussoirs for reasons of simplicity, a casing usually being constituted by the juxtaposition along its axis of a continuous series of rings, each ring being constituted by the circumferential juxtaposition of the required number of elementary voussoirs. The double voussoirs shown in FIGS. 2 and 3, each comprise two elementary voussoirs juxtaposed in the direction of the axis X—X of a casing which is, as in the two other embodiments, constituted by a similar series of rings formed of such double voussoirs. These double voussoirs are also sectioned in their middle in a meridian plane to show the structure more clearly.

Figure 2:
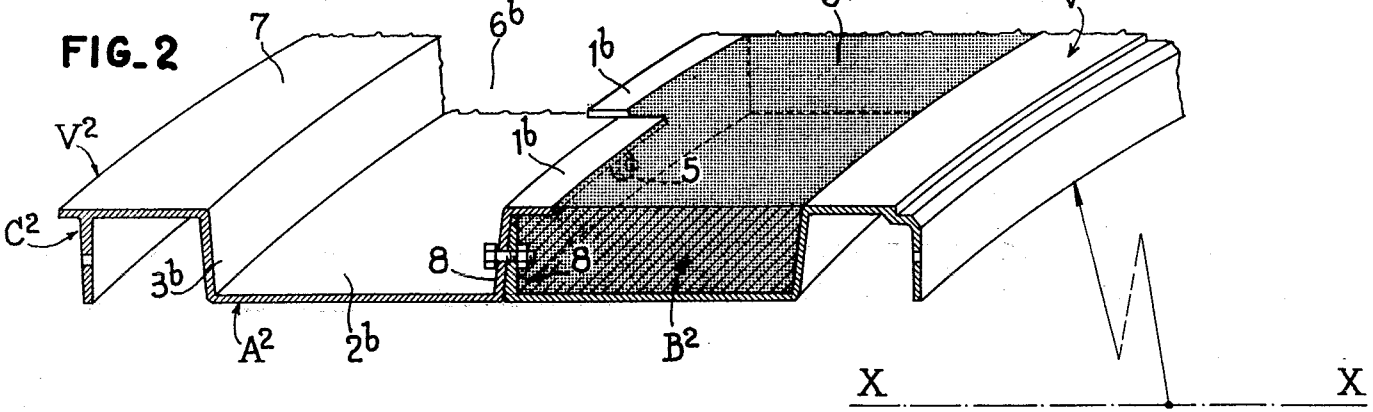
FIGS. 2 and 3 are perspective views of two double voussoirs in accordance with a second and third embodiment respectively of the invention.

Each voussoir, whether this is one of the single voussoirs $V^1$ or $V^4$ shown in FIGS. 1 and 4 or one of the elementary voussoirs $V^2$ and $V^3$ shown in FIGS. 2 and 3, is constituted by a mass of concrete or like material $B^1$ to $B^4$ and a reinforcement of spheroidal graphite cast iron $A^1$ to $A^4$. This reinforcement comprises in all cases a web having the general shape of a portion of a cylinder, the different structures of which will be described hereinafter, and a fixing frame $C^1$ to $C^4$ which is in one piece with the web. This frame is in all cases radially extending and has a curvilinear rectangular shape, which means that it is constituted by four planar walls two of which are disposed in planes perpendicular to the axis X—X and the other two in planes containing said axis, these walls being radially defined by two cylindrical surfaces having the axis X—X, one surface, which is the nearer to this axis, being termed the inner surface and the other the outer surface. The two sides of each one of the walls are substantially parallel apart from a slight rake required by the moulding method adopted for producing the reinforcement.

In the embodiment shown in FIG. 1, the web of the reinforcement $A^1$ comprises, along the outer cylindrical surface of the reinforcement, two continuous flanges $1^a$ in one piece with the frame throughout the length of each one of the walls of the latter perpendicular to the axis X—X, these two flanges projecting axially inwardly of the frame toward each other and defining therebetween and with the meridian walls of the frame a curvilinear rectangular opening 2. These flanges have a constant thickness except at their ends in the circumferential direction where they have a part of increasing thickness. The web also has along the inner cylindrical surface of the reinforcement a rectangular plate $2^a$ which has a contour substantially identical to that of the opening 2 and is disposed below the opening 2 in the radial direction, this plate being moulded with the two meridian walls of the frame to which it is moreover connected by triangular-shaped rib portions. The plate is connected to each one of the two flanges $1^a$ by evenly-spaced struts $3^a$, for example three struts, which extend radially and are moulded in one piece with the plate and the flanges. Each of the four walls of the frame $C^1$ has apertures 4 for fixing the voussoirs to each other by means of bolts 5.

The frame $C^1$ and the web constituted by the flanges $1^a$ and the plate $2^a$ define a cavity $6^a$ of approximately rectangular-sided shape and the whole of this cavity $6^a$ is occupied by the mass of concrete $B^1$. In the course of manufacture, once the reinforcement $A^1$ is obtained by moulding or casting, the concrete is placed in position in the cavity $6^a$ before mounting the voussoir in the tunnel or passage or after this mounting, in which latter case the voussoirs are, at the moment of mounting, solely constituted by the reinforcement. In both cases after the concrete has set, the reinforcement and the mass of concrete have a perfect interconnection. In order to still further increase this interconnection, a layer of an adhesive substance may be applied to the inner surfaces of the walls of the frame $C^1$ or on the surfaces facing the cavity $6^a$ of the flanges $1^a$ and of the plate $2^a$ or on all of these surfaces. For reasons of clarity, the mass of concrete $B^1$ has been shown in only two of the voussoirs. The axial dimension of each one of the flanges $1^a$ is substantially the same and is equal to roughly one half of that of the plate $2^a$. Moreover, as is also the case with the three other embodiments, the overall axial dimension of the frame is of the order of 4 to 5 times its radial dimension, that is to say the distance between the inner and outer cylindrical surfaces.

In the embodiment shown in FIG. 2, the web of the reinforcement $A^2$ of each one of the elementary voussoirs comprises two substantially rectangular plates 7 and $2^b$ which are moulded in one piece with the frame and each project axially inwardly of the latter from the corresponding one of the walls of this frame which are perpendicular to the axis X—X, the plate 7 being disposed along the outer cylindrical surface of the reinforcement and the other plate $2^b$ along its inner cylindrical surface. The two rectangular plates are interconnected throughout their length by a continuous wall $3^b$ which is perpendicular to the axis X—X and is moulded in one piece with the plate.

The two reinforcements $A^2$ of the two elementary voussoirs are in juxtaposed relation in the direction of the axis X—X so that their frames bear against each other by two walls 8 which are perpendicular to the axis X—X and adjacent the two plates $2^b$. Each one of these walls 8 has on its outer edge and on a different half of its length a flange $1^b$ which is integral therewith and extends axially from the wall 8 in the opposite direction to the plate $2^b$. Each reinforcement, which has a meridian section in the general shape of a rectangular waveform, defines by its plate $2^b$, its walls $3^b$ and 8 and the diametral walls of the frame, a cavity $6^b$ having a generally rectangular-sided shape the whole of which is occupied by the mass of concrete $B^2$. In this way there is also obtained an excellent interconnection between the mass of concrete and the reinforcement with optional interposition of a layer of adhesive substance. The elementary voussoirs are interconnected and the different double voussoirs are interconnected by bolts 5. The axial dimension of each plate $2^b$, and consequently of the cavity $6^b$ and of the corresponding mass of concrete $B^2$, is greater than that of the plate 7 and is preferably of the order of 2.5 times the latter.

The embodiment shown in FIG. 3 is identical to that shown in FIG. 2 except that the reinforcement $A^3$ does not have a flange similar to the flange $1^b$ shown in FIG. 2. The walls 8 of the frame have a slightly lesser height and there is provided a T-section member 9 whose vertical limb is clamped between the walls 8 whereas its flange $1^c$ projects radially above the cavity defined by the reinforcements in the immediate vicinity of the walls 8.

In the embodiment shown in FIG. 4, the web of the reinforcement $A^4$ comprises a substantially rectangular continuous plate $2^d$ disposed along the inner cylindrical surface of the reinforcement and on the whole of the opening defined by the frame with which it is integral. The web further has a planar rib $3^d$ which is disposed in the middle of the plate $2^d$ in a plane perpendicular to the axis X—X and which extends outwardly only on a part of the height of the frame, this rib being moulded in one piece with the plate $2^d$. The latter also has outwardly extending portions defining cavities 10 which are moulded in one piece with the plate and allow access to the bolts 5 from inside the casing. The rib $3^d$ has on its free edge axially extending lugs $1^d$, for example two lugs, which extend axially each one in a different direction, the circumferential dimension of these lugs being relatively small with respect to that of the rib $3^d$. The whole of the cavity $6^d$ defined by the frame $C^4$ and the plate $2^d$ is occupied by the mass of concrete $B^4$ which is thus perfectly connected to the reinforcement.

In all cases, owing to the effective interconnection between the mass of concrete and the cast iron reinforcement, the values of permissible stress for both materials are obtained simultaneously bearing in mind their respective modulus of elasticity. The concrete is placed in position in a particularly easy manner and this is even possible after the reinforcement has been mounted in the excavation of the tunnel or passage.

The moulding or casting of the reinforcement can be moreover carried out in the foundry without the use of a core owing to the particularly advantageous shapes employed in the embodiments shown in FIGS. 1 to 3.

The voussoirs have a perfectly smooth surface both internally, which limits the pressure drop in the case of a fluid flowing inside the casing, and externally, which reduces the volume in which filler material must be injected between the outer surface of the casing and the neighbouring ground.

Note that the struts $3^a$, the walls $3^b$ or the ribs $3^d$ impart to the concrete an increased shear strength.

Tests carried out have shown that, compared with voussoirs constructed solely of cast iron and having a performance of the same order, the overall saving in weight is of the order of 32% in respect of the embodiment shown in FIG. 1, 24% in respect of the embodiment shown in FIG. 2, 28% for that shown in FIG. 3 and 20% for that shown in FIG. 4.

Having now described my invention what I claim as new and desire to secure by Letters Patent is:

1. A composite voussoir comprising a coherent mass of material, such as concrete or the like, and a metal reinforcement having web means which have substantially the shape of a portion of a cylinder and a peripheral fixing frame of curvilinear substantially rectangular four-sided shape extending substantially radially outwardly of the web means, a cavity defined by the web means and the frame, which cavity is open at least partially in the radial outward direction of the voussoir, the mass of material being contained in the cavity and having a first portion in radial engagement with at least a portion of the web means and a second portion radially outwardly offset from said portion of the web means, the fixing frame being defined radially outwardly by an outer geometric cylindrical surface and radially inwardly by an inner geometric cylindrical surface radially spaced from the outer cylindrical surface, the mass of material substantially completely radially filling the space between the outer and inner cylindrical surfaces, the reinforcement having means for hooking and radially retaining the mass of material, said hooking means comprising a plurality of spaced projecting flanges alternately extending in opposite directions substantially parallel to the web means, having radially offset positions relative to said portion of the web means, and engaging said second portion of the mass of material, the flanges being in one piece with the reinforcement and projecting from the top of a planar radially extending reinforcing rib which is in one piece with the web means of the reinforcement.

2. A composite voussoir comprising a coherent mass of material, such as concrete or the like, and a metal reinforcement having web means which have substantially the shape of a portion of a cylinder and a peripheral fixing frame of curvilinear substantially rectangular four-sided shape extending substantially radially of the web means, the web means comprising, along an outer cylindrical surface, two continuous parallel flanges integral with the frame and axially inwardly projecting from two first opposite sides of said four sides of the frame and defining with the other two sides of the frame a curvilinear substantially rectangular opening in said outer cylindrical surface and a plate extending along an inner cylindrical surface radially spaced from the outer cylindrical surface, the plate being integral with said other two sides of the frame and having a shape and size substantially corresponding to the shape and size of said opening, and a plurality of integral substantially radially extending widely spaced narrow struts interconnecting the two flanges and the plate, a cavity defined by the four sides of the frame and said two cylindrical surfaces being occupied by the whole of the mass of material.

3. A composite voussoir comprising a coherent mass of material, such as concrete or the like, and a metal reinforcement having web means which have substantially the shape of a portion of a cylinder and a peripheral fixing frame of curvilinear substantially rectangular four-sided shape extending substantially radially of the web means, the web means comprising two parallel continuous plate portions which are integral with the frame and axially inwardly extend from two first opposite sides of said four sides of the frame, one plate portion along an outer cylindrical surface and the other plate portion along an inner cylindrical surface radially spaced from the outer cylindrical surface, and a substantially radially extending wall interconnecting the two plate portions throughout their length, two cavities defined by the frame and the web means between the two cylindrical surfaces being open in opposite radial directions, the cavity which is radially outwardly open being wholly occupied by the mass of material, the reinforcement having means for hooking and radially retaining the mass of material, said hooking means comprising a projecting flange having a radially offset position relative to said plate portion on the inner cylindrical surface.

4. A double voussoir as claimed in claim 3, wherein the axial dimension of said outwardly facing cavity is of the order of 2 to 3 times that of the second cavity.

5. A double voussoir comprising two adjacent voussoirs and means interconnecting the two voussoirs, each voussoir comprising a coherent mass of material, such as concrete or the like, and a metal reinforcement having web means which have substantially the shape of a portion of a cylinder and a peripheral fixing frame of curvilinear substantially rectangular four-sided shape extending substantially radially of the web means, the web means comprising two parallel continuous plate portions which are integral with the frame and axially inwardly extend from two first opposite sides of said four sides of the frame, one plate portion along an outer cylindrical surface and the other plate portion along an inner cylindrical surface radially spaced from the outer cylindrical surface, and a substantially radially extending wall interconnecting the two plate portions throughout their length, two cavities defined by the frame and the web means between the two cylindrical surfaces being open in opposite radial directions, the cavity which is radially outwardly open being wholly occupied by the mass of material, one of said two first sides of the frame from which first side said other plate portion extends in each voussoir being connected to the corresponding one of said two first sides of the frame of the other voussoir by said interconnecting means and each of said one first sides of the two voussoirs having on its outer edge a flange which is integral therewith and axially extends in radially offset relation to said other plate portion for hooking and radially retaining the mass of material in said cavity, said two flanges extending circumferentially in a different half of the corresponding one of said first sides.

6. A double voussoir comprising two adjacent voussoirs and means interconnecting the two voussoirs, each voussoir comprising a coherent mass of material, such as concrete or the like, and a metal reinforcement having web means which have substantially the shape of a portion of a cylinder and a peripheral fixing frame of curvilinear substantially rectangular four-sided shape extending substantially radially of the web means, the web means comprising two parallel continuous plate portions which are integral with the frame and axially inwardly extend from two first opposite sides of said four sides of the frame, one plate portion along an outer cylindrical surface and the other plate portion along an inner cylindrical surface radially spaced from the outer cylindrical surface, and a substantially radially extending wall interconnecting the two plate portions throughout their length, a cavity defined by the frame and the web means between the two cylindrical surfaces being open in the radial direction and being wholly occupied by the mass of material, one of said two first sides of the frame from which first side said other plate portion extends in each voussoir being connected to the corresponding one of said two first sides of the frame of the other voussoir by said interconnecting means, a T-section member being clamped between said ones of said two sides of the voussoirs by said interconnecting means, the T-section member having two flanges extending respectively in overlapping and radially offset relation to said other plate portions of the voussoirs for hooking and radially retaining the mass of material in the cavities of the voussoirs.

7. A composite voussoir comprising a coherent mass of material, such as concrete or the like, and a metal reinforcement having web means which have substantially the shape of a portion of a cylinder and a peripheral fixing frame of curvilinear substantially rectangular four-sided shape extending a substantially radially outwardly of the web means, the web means of the reinforcement comprising a continuous plate portion which is in one piece with the frame along an inner cylindrical surface, the whole of the outwardly opening cavity thus defined by the frame and the plate portion being occupied by the mass of material, the plate portion having a substantially radially extending planar reinforcing rib integral with the plate portion and carrying a plurality of spaced integral anchoring lugs which axially and alternately extend from the top of the rib in opposite directions substantially parallel to the plate portion and are radially spaced from the plate portion for hooking and radially retaining the mass of material against the plate portion.

* * * * *